US005176330A

United States Patent [19]

Tone

[11] Patent Number: 5,176,330

[45] Date of Patent: Jan. 5, 1993

[54] TRAVERSE DEVICE

[75] Inventor: Shoichi Tone, Kyoto, Japan

[73] Assignee: Murata Kikai Kabushiki Kaisha, Kyoto, Japan

[21] Appl. No.: 813,853

[22] Filed: Dec. 26, 1991

[30] Foreign Application Priority Data

Dec. 28, 1990 [JP] Japan ..... 2-416169

[51] Int. Cl.[5] ..... B65H 54/28

[52] U.S. Cl. ..... 242/43 A

[58] Field of Search ..... 242/43 A, 43 R, 18.1, 242/158 B

[56] References Cited

U.S. PATENT DOCUMENTS

| | | | |
|---|---|---|---|
| 834,420 | 10/1906 | Taylor | 242/43 A |
| 1,475,525 | 11/1923 | Tober | 242/43 A |
| 3,374,961 | 3/1968 | Otsuka et al. | 242/43 A |
| 4,505,437 | 3/1985 | Schippers et al. | 242/43 A |
| 4,867,386 | 9/1989 | Schroff et al. | 242/43 A |

FOREIGN PATENT DOCUMENTS

| | | | |
|---|---|---|---|
| 37025 | 10/1971 | Japan | 242/43 A |
| 29054 | of 1911 | United Kingdom | 242/43 A |

*Primary Examiner*—Stanley N. Gilreath

*Attorney, Agent, or Firm*—Spensley Horn Jubas & Lubitz

[57] ABSTRACT

A traverse device in which rotary members each having yarn guide blades are arranged to be overlaid and rotated in the direction opposite to each other, and a traverse guide member is provided along the motion locus of the yarn guide blades, wherein the number of the yarn guide blades of the rotary members is differentiated, and the rotary speed is differentiated by a reciprocal number of the ratio of the number. The traverse of yarn and speeds of forward path and backward path are differentiated, and the number of windings between the forward path and the backward path is changed.

5 Claims, 3 Drawing Sheets

TRAVERSE DEVICE

BACKGROUND OF THE INVENTION

1. Field of the Invention

The present invention relates to a traverse device in which a yarn is reciprocated (hereinafter referred to as traverse) in a case where a yarn is formed into a winding package, and particularly to a traverse device in which two rotary members having two or more yarn guide blades are arranged to be overlaid and rotated in the direction opposite to each other, and a traverse guide surface is provided along the motion locus of said yarn guide blades.

2. Prior Art

A conventional traverse device uses a groove cam mechanism, and the traverse of yarn is effected by the reciprocating motion of the traverse guide in engagement with the groove cam mechanism. Therefore, there occurs extremely great shocks generated at a turn point of the traverse guide and noises generated therefrom to limit smooth high-speed rotation. As means for solving drawbacks encountered in such a groove cam mechanism as noted above, there is known a traverse device which uses yarn guide blades which rotated in the direction opposite to each other to traverse the yarn.

The traverse device using the yarn guide blades which rotate in the direction opposite to each other will be described hereinbelow with reference to FIGS. 4 to 6. In FIGS. 4 and 5, a spun yarn Y is alternately traversed by yarn guide blades 3, 3', 4, 4' provided on rotary members 1 and 2 and wound on a winding package 7 rotated by a touch roller 6 while being guided on a traverse guide surface d of a traverse guide member 5. The rotary members 1 and 2 have one and the same rotating center and are provided on rotary shafts 8 and 9, respectively so that they are rotated in the direction opposite to each other. A bevel gear 10 is provided on the other end of the rotary shaft 8, and a bevel gear 11 is provided on the other end of the other rotary shaft 9. These bevel gears 10 and 11 are meshed with a bevel gear 12 driven by an electric motor 13 so that rotating motion opposite to each other are applied to the rotary members 1 and 2. Around the rotary members 1 and 2 which have one and the same rotating center and rotate in the direction opposite to each other, yarn guide blades 3, 3' and yarn guide blades 4, 4' are secured to the rotary member 1 and the rotary member 2, respectively, at intervals of 180° by means of screws or the like.

The device will be described in more detail with reference to FIG. 6. The distance from the rotating center of the respective extreme ends of the yarn guide blades 3, 3' and 4, 4' is the same radius, and a circular locus indicated at chain line C is depicted by the rotation thereof. The yarn Y is carried by the sides of the yarn guide blades and performs left and right traverse motions while being exchanged with yarn guide blades which rotate in the direction opposite to each other at turn points a and b along the curve of a traverse guide surface d of the traverse guide member 5. In order to secure positive and smooth turning of a yarn at the turn points a and b, the following structure is employed. More specifically, mounting positions of the yarn guide blades 3 and 3' and 4 and 4' with respect to the rotary members 1 and 2 are spaced through 180°, and an angle of aOb is 90° in order that the upper and lower guide blades are overlaid at the turn points a and b of the traverse motion. In order to positively carry out the delivery of yarn, projecting guides are provided on the upper and lower surfaces in the proximity of a position at which the yarn guide blades are overlaid at the turn points a and b. Further, in order to positively carry out the delivery of yarn, the rotating center of the rotary members 1 and 2 is sometimes slightly deviated.

In the traverse device shown in FIGS. 4 and 6, the speed of forward path of the traverse is the same as that of backward path (the number of winding is constant). Accordingly, as shown in FIG. 3*b*, an intersection g between a forward path e and a backward path f forms a straight line in an axial direction of the winding package. Therefore, there arises a problem in that when the wound package is unwound, it tends to be caught at the intersection g, resulting in a poor releasability, and there likely occurs a buldge phenomenon in which opposite ends of the wound package becomes buldged.

SUMMARY OF THE INVENTION

The present invention has been achieved in view of the aforesaid problem encountered in prior art. An object of the present invention is to provide a traverse device using yarn guide blades which rotated in the direction opposite to each other, which is excellent in releasability and in which the buldge is unlikely to occur.

In order to achieve the aforesaid object, the present in invention provides a traverse device in which two rotary members each having yarn guide blades are arranged to be overlaid and rotated in the direction opposite to each other, and a traverse guide member is provided along the motion locus of the yarn guide blades, characterized in that the number of the yarn guide blades of the two rotary members is differentiated, and the rotary speed is differentiated by a reciprocal number of the ratio of the number of the yarn guide blades.

When the number of the yarn guide blades of two rotary members is differentiated and the rotary speeds thereof are differentiated by a reciprocal number of the ratio of number of the yarn guide blades, the speed of forward path of the yarn traverse is different from that of backward path. Since the number of revolutions of the touch roller is constant, the number of windings of the forward path is different from that of the backward. As a result, intersections of yarns are scattered.

DETAILED DESCRIPTION OF PREFERRED EMBODIMENTS

Figure 1:
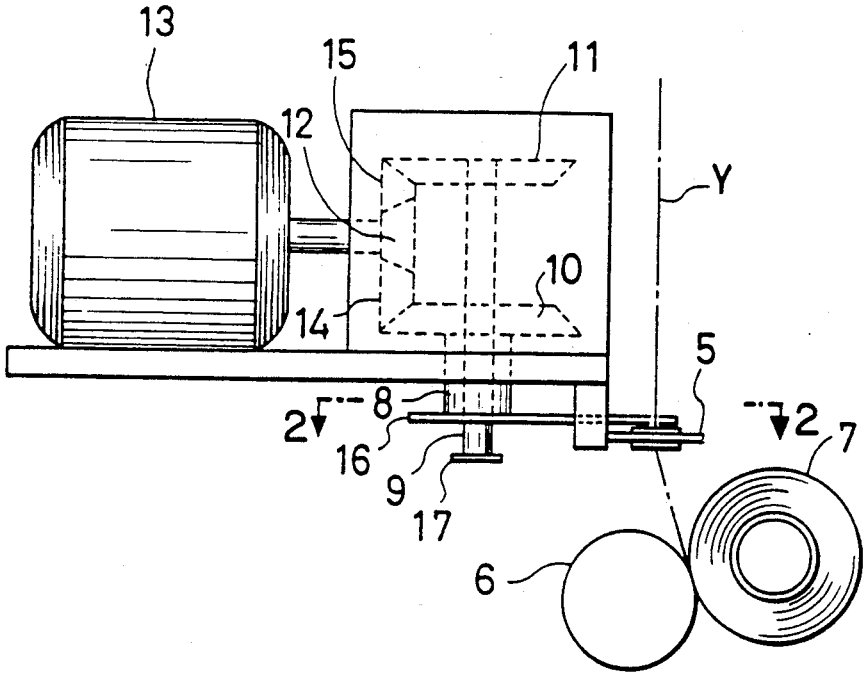
FIG. 1 is a side view of a traverse device according to the present invention.
Figure 2:
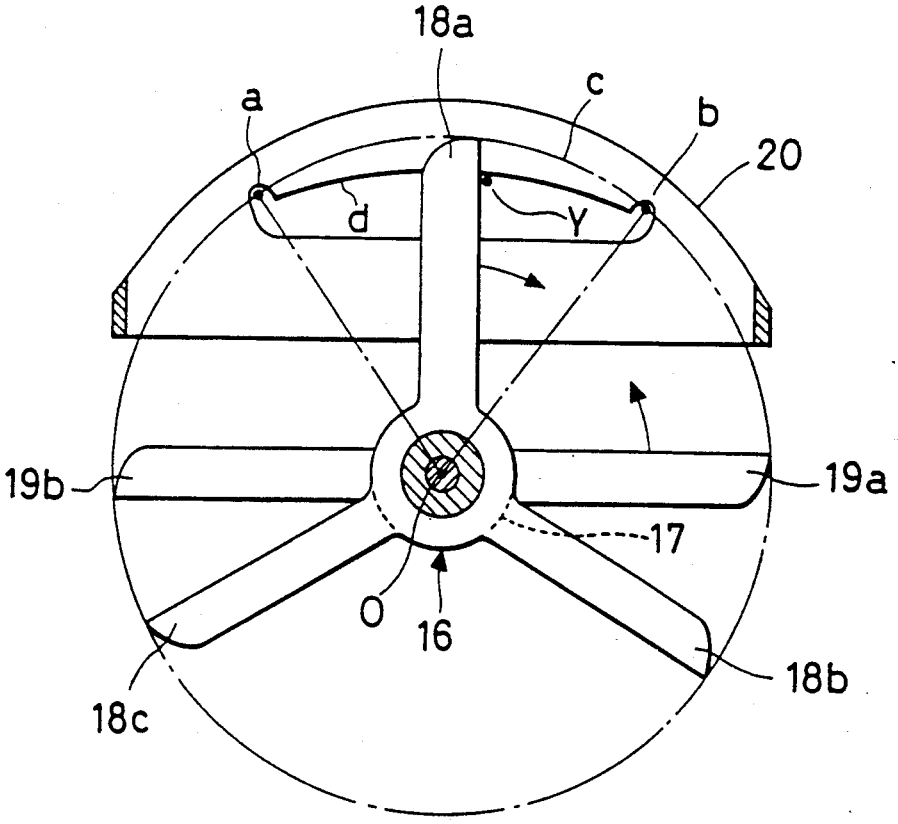
FIG. 2 is a sectional view taken on line 2—2 of FIG. 1.
Figure 6:
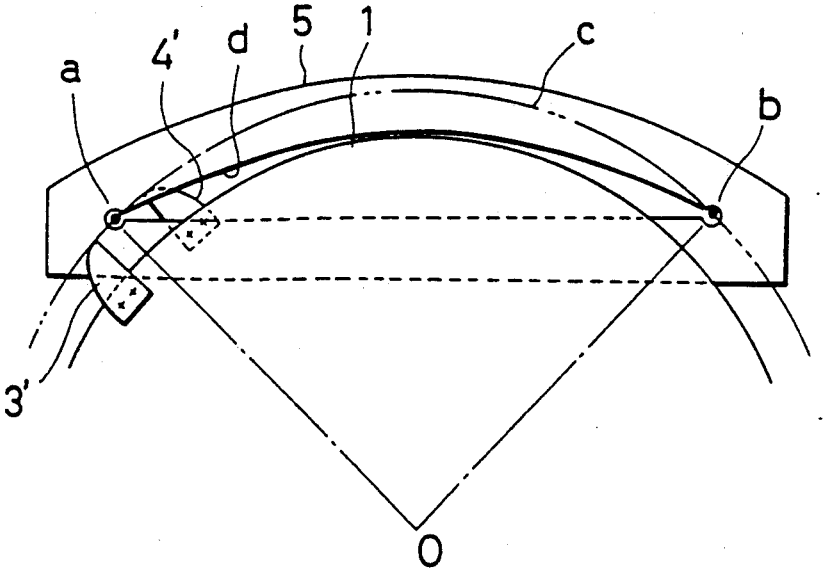
FIG. 6 PRIOR ART
FIG. 6 is a sectional view taken on line 6—6 of FIG. 4.
Figure 4:
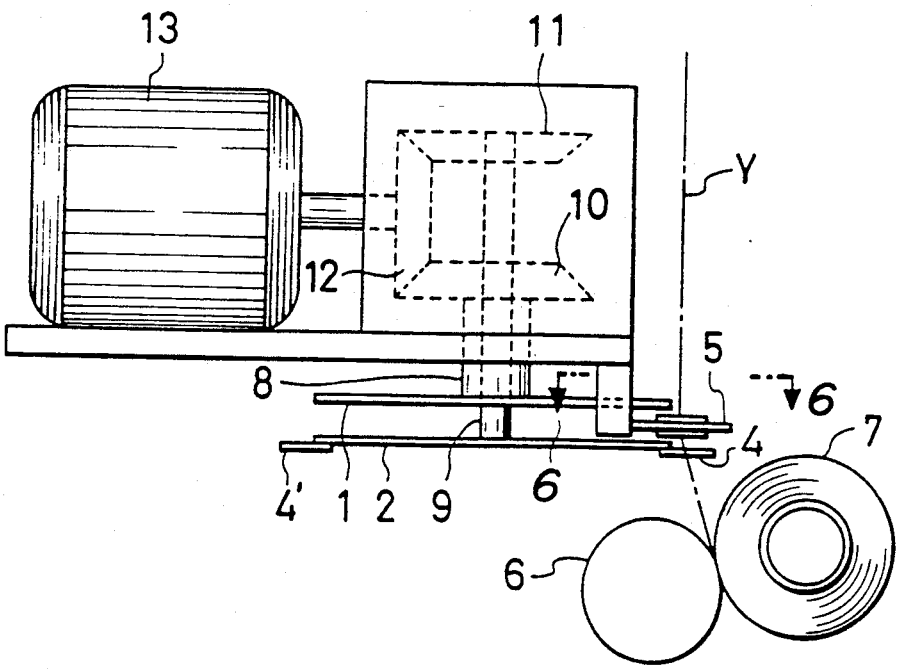
FIG. 4 PRIOR ART
FIG. 4 is a side view of a conventional traverse device.
Figure 5:
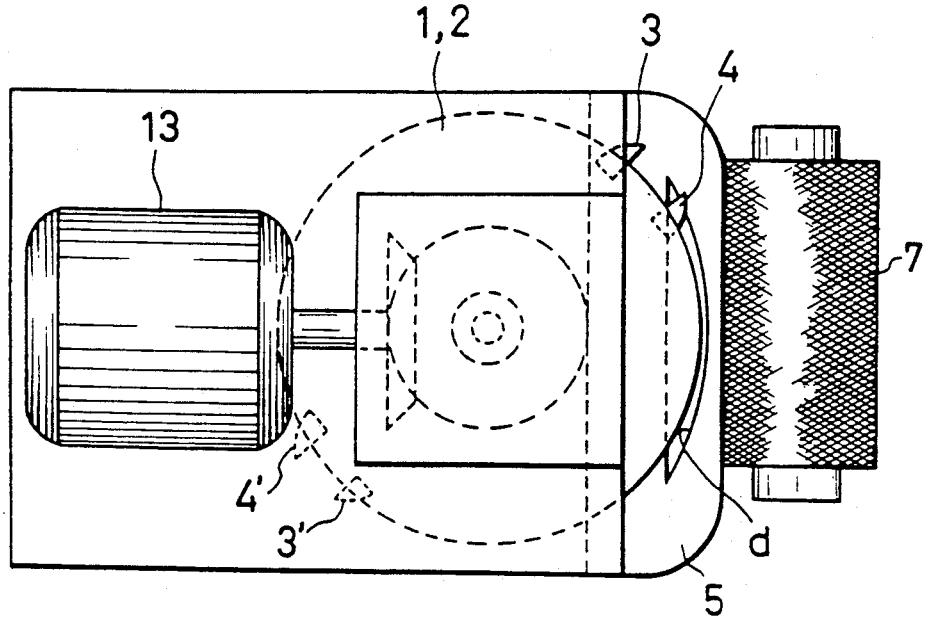
FIG. 5 PRIOR ART
FIG. 5 is a top view of a conventional traverse device.

An embodiment of the present invention will be described below with reference to the drawings. FIG. 1 is a side view of a traverse device according to the present invention; and FIG. 2 is a sectional view taken on line 2—2 of FIG. 1. Parts which operate in the same manner as those explained in connection with FIGS. 4 to 6 of prior art are indicated by the same reference numerals and a description thereof is omitted.

In FIG. 1, between a bevel gear 12 and bevel gears 10 and 11 are provided intermediate bevel gears 14, 15 different in number of teeth, and rotary members 16 and 17 have different rotational speeds. In the illustrated embodiment, the ratio of number of teeth between the intermediate bevel gear 14 and the intermediate bevel gear 15 is 3:2, and the ratio of rotational speed between the rotary member 16 and the rotary member 17 is 2:3. For example, if the number of revolutions of the rotary member 16 is 600 rpm, the number of revolutions of the rotary member 17 is 900 rpm.

In FIG. 2, the rotary member 16 has three yarn guide blades 18*a*, 18*b* and 18*c* at positions divided by 120° in the circumference thereof, and the rotary member 17 has two yarn guide blades 19*a* and 19*b* at positions divided by 180° in the circumference thereof. That is, the ratio of the number of blades between the rotary member 16 and the rotary member 17 is 3:2 which is a reciprocal ratio of 2:3 of the ratio of rotational speed between the rotary members 16 and 17. A phase difference between the yarn guide blades 18*a* , 18*b* and 18*c* and the yarn guide blades 19*a* and 19*b* is deviated at the ratio of the number of revolutions therebetween with the shown position as a reference.

In FIG. 2, an angle aOb formed by turn points a and b of a traverse guide surface d of a traverse guide member 20 is 72°. That is, when the slow yarn guide blade 18*a* rotates through 36° clockwise from the shown position and arrives at the turn point b, the fast yarn guide blade 19*a* rotates through 54° counterclockwise from the shown position and arrives at the turn point b, and the traverse guide surface d of the traverse guide member 20 is determined so that positions at which 36°:54° is 2:3 of the ratio of rotary speeds assume turn points.

The operation of the traverse device constructed as described above will be explained hereinafter. In FIG. 2, the yarn Y is guided to be moved rightward along the traverse guide surface d by the yarn guide blade 18*a* which is slow in rotational speed. When the yarn guide blade 18*a* arrives at the turn point b, the yarn guide blade 19*a* arrives at the turn point b, and the yarn is delivered. Subsequently, the yarn guide blade 19*a* is guided to be moved leftward and arrives at the turn point a, then the yarn guide blade 18*c* arrives at the turn point a and the yarn is delivered. The above-described steps are repeated to effect the traverse of the yarn Y. Since the ratio of rotational speeds between the rotary members 16 and 17 is 2:3 , the number of windings of the forward path is different from that of the backward path.

Figure 3A:
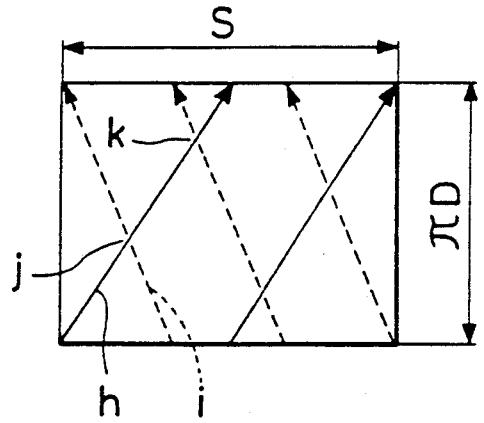
FIG. 3*a* illustrates the operation of a traverse device in accordance with one embodiment of the present invention.
Figure 3B:
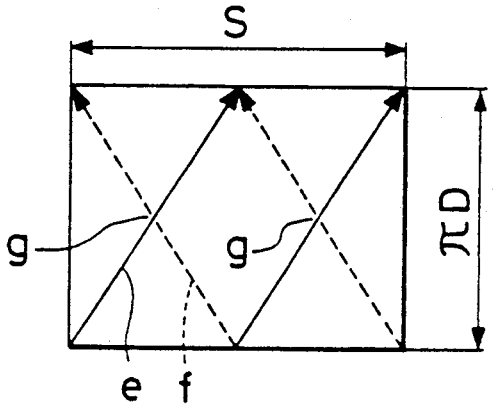
FIG. 3b PRIOR ART
FIG. 3*b* illustrates the operation of a conventional traverse device.

Next, a package different in the number of windings will be described with reference to FIG. 3*a*. In FIG. 3*a*, the number of windings of the forward path h is 4 and that of the backward path i is 6, as illustrated. Intersections of the forward path h and the backward path i are scattered into two points j and k. As compared with the case of FIG. 3*b* in prior art, yarn caught is decreased when the yarn is unwound, and the buldge phenomenon in which opposite ends of the package buldge is relieved. Reference symbol S is a traverse width, and D is a diameter of a package.

While in the aforementioned embodiment, a combination of two blades and three blades has been illustrated, it is to be noted that the present invention is not limited thereto but even in cases of a combination of two blades and four blades or a combination of three blades and four blades, a shape of a traverse guide member and a phase difference between blades are determined so that the rotational speed is set to a reciprocal number of the ratio of number of blades and turn points are coincided, whereby the operation and effect similar to those of the aforementioned embodiment can be obtained.

The present invention provides a traverse device in which two rotary members each having yarn guide blades are arranged to be overlaid and rotated in the direction opposite to each other, and a traverse guide member is provided along the motion locus of said yarn guide blade, wherein the number of the yarn guide blades of the two rotary members is differentiated, and the rotary speed is differentiated by a reciprocal number of the ratio of the number of the yarn guide blades. Therefore, the traverse of yarn and the speeds of forward path and backward path are different (the number of windings between the forward path and the backward path is different). Since the intersections of yarns are scattered, the releasability is improved and the buldge phenomenon is hard to occur.

What is claimed is:

1. A traverse device, comprising:

a first rotary member defining a first predetermined number of yarn guide blades;

a second rotary member, in spaced relation to the first rotary member, defining a second predetermined number of yarn guide blades, the second predetermined number being different than the first predetermined number; and rotating means for rotating the first rotary member at a first speed and the second rotary member at a second speed such that a ratio of the first and second speeds is substantially equal to the inverse of a ratio of the first and second numbers of yarn guide blades.

2. The traverse device of claim 1, wherein the guide blades define an arcuate path, the device further comprising:

a traverse guide member provided along the path of the yarn guide blades.

3. The traverse device of claim 2, wherein the traverse guide member defines turning points, and wherein locations of the turning points and the speeds of the rotary members are defined such that the blades of the respective rotary members cross at the turning points.

4. A traverse device, comprising:

a first rotary member defining a first number of yarn guide blades and an axis of rotation;

a second rotary member, in spaced relation to, and defining the same axis of rotation as, the first rotary member, the second rotary member defining a second number of yarn guide blades, the second number of blades being different than the first number of blades;

a first rotary shaft defining first and second ends, the first end supporting the first rotary member and the second end supporting a first gear defining a first number of teeth;

a second rotary shaft defining first and second ends, the first end supporting the second rotary member and the second end supporting a second gear defining a second number of teeth, the second number of teeth being different then the first number of teeth; and a third gear driven by a motor, the third gear positioned between, and meshed with, the first and second gears;

wherein a ratio of respective speeds of the first and second rotary members is substantially equal to the inverse of a ratio of the first and second numbers of blades.

5. A traverse device in which two rotary members each having yarn guide blades are arranged to be overlaid and rotated in the direction opposite to each other, and a traverse guide member is provided along the motion locus of said yarn guide blade, wherein said traverse device includes first and second rotary members having one and same rotating center and being provided on a first rotary shaft and a second rotary shaft, respectively, a plurality of first yarn guide blades provided in a circumference of the first rotary member, a plurality of second yarn guide blades provided in a circumference of the second rotary member, a first bevel gear provided on the other end of the first rotary shaft, a second bevel gear provided on the other end of the second rotary shaft, a third bevel gear driven by an electronic motor, and a first and second intermediate bevel gears which are provided between and meshed with the third bevel gear and the first and second bevel gears and are different in number of teeth, the number of said first yarn guide blades and said second yarn guide blades being differentiated and the rotary speed of said first rotary member and said second rotary member being differentiated by a reciprocal number of the ratio of the number of the first and second yarn guide blades.

* * * * *